US008087532B2

(12) United States Patent
Brown et al.

(10) Patent No.: US 8,087,532 B2
(45) Date of Patent: Jan. 3, 2012

(54) WASTE CONTAINER

(75) Inventors: Jolie Brown, Bethesda, MD (US); Eric F. Cabahug, Fairfax, VA (US); Benjamin F. Feldman, Reston, VA (US); Rachel Katherine Newman, Bethesda, MD (US)

(73) Assignee: Brown Newman, L.L.C., Besthesda, MD (US)

( * ) Notice: Subject to any disclaimer, the term of this patent is extended or adjusted under 35 U.S.C. 154(b) by 449 days.

(21) Appl. No.: 12/355,346

(22) Filed: Jan. 16, 2009

(65) Prior Publication Data

US 2009/0184125 A1 Jul. 23, 2009

Related U.S. Application Data

(60) Provisional application No. 61/022,289, filed on Jan. 18, 2008.

(51) Int. Cl.
*B65D 43/26* (2006.01)
*B65D 51/18* (2006.01)
*B65D 51/04* (2006.01)

(52) U.S. Cl. ..... 220/264; 220/254.1; 220/254.3; 220/254.5; 220/254.6; 220/255; 220/260; 220/262; 220/263; 220/495.01; 220/495.05; 220/495.06; 220/495.08; 220/502; 220/826; 220/827; 220/908; 220/908.1; 220/908.2; D34/7; D34/9

(58) Field of Classification Search ..... 220/87.1, 220/254.1, 254.3, 254.5, 254.6, 255, 260, 220/262, 263, 264, 495.01, 495.05, 495.06, 220/495.08, 502, 826, 827, 908, 908.1, 908.2, 220/FOR. 192; D34/7, 8, 9, 10
See application file for complete search history.

(56) References Cited

U.S. PATENT DOCUMENTS

| | | | | |
|---|---|---|---|---|
| 816,989 | A | | 4/1906 | Moler et al. |
| 1,013,775 | A | | 1/1912 | Hoffman |
| 1,360,732 | A | * | 11/1920 | Dawson ..... 220/254.2 |
| 2,112,465 | A | | 3/1938 | Maish |
| 2,271,918 | A | | 2/1942 | Glowka |
| 2,411,430 | A | | 11/1946 | Hodson |
| 3,082,901 | A | | 3/1963 | Nakagawa |
| 3,184,100 | A | | 5/1965 | Thomas |
| 3,321,103 | A | | 5/1967 | Phillips |
| 3,434,625 | A | | 3/1969 | Embry, Jr. |
| 3,878,572 | A | | 4/1975 | Eriksson |

(Continued)

FOREIGN PATENT DOCUMENTS

JP 2003/118806 4/2003

(Continued)

*Primary Examiner* — Anthony Stashik
*Assistant Examiner* — Madison L Wright
(74) *Attorney, Agent, or Firm* — Sterne, Kessler, Goldstein & Fox P.L.L.C.

(57) ABSTRACT

A waste container includes a top chamber, a base chamber, upper and lower lids, and a drive mechanism mechanically coupling the lower lid with the upper lid. The upper lid is disposed on the top chamber and moves between a closed position covering a first opening and an open position exposing the first opening. The lower lid is disposed on the base chamber and moves between a closed position covering a second opening and an open position exposing the second opening. The drive mechanism is actuated so as to move the lower lid to the open position when the upper lid moves to the closed position from the open position. The lower lid returns to the closed position when the upper lid is in the closed position.

20 Claims, 13 Drawing Sheets

U.S. PATENT DOCUMENTS

| | | | |
|---|---|---|---|
| 4,164,178 | A | 8/1979 | Baumann et al. |
| D258,258 | S | 2/1981 | Haddock |
| 4,427,110 | A | 1/1984 | Shaw, Jr. |
| 4,453,648 | A | 6/1984 | Harris et al. |
| 4,519,104 | A | 5/1985 | Nilsson |
| 4,646,684 | A | 3/1987 | Embry, Jr. |
| 4,869,049 | A | 9/1989 | Richards et al. |
| 4,953,740 | A | 9/1990 | Koda |
| 4,972,966 | A | 11/1990 | Craft, Jr. |
| 5,147,055 | A | 9/1992 | Samson et al. |
| 5,158,199 | A | 10/1992 | Pontius |
| 5,174,462 | A | 12/1992 | Hames |
| 5,385,269 | A | 1/1995 | Richter et al. |
| 5,511,682 | A | 4/1996 | Pace |
| 5,520,303 | A | 5/1996 | Bernstein et al. |
| 5,535,913 | A | 7/1996 | Asbach et al. |
| 5,540,351 | A | 7/1996 | Luescher |
| 5,651,231 | A | 7/1997 | Garland |
| 5,655,680 | A | 8/1997 | Asbach et al. |
| 5,765,339 | A | 6/1998 | Garland |
| D420,182 | S | 2/2000 | Roudebush |
| D422,123 | S | 3/2000 | Roudebush |
| D431,700 | S | 10/2000 | Roudebush |
| 6,128,890 | A | 10/2000 | Firth |
| 6,370,847 | B1 | 4/2002 | Jensen et al. |
| 6,516,588 | B2 | 2/2003 | Jensen et al. |
| 6,540,103 | B2 | 4/2003 | Silvers |
| 6,647,923 | B2 | 11/2003 | Nicoud et al. |
| D486,283 | S | 2/2004 | Brand |
| 6,719,194 | B2 | 4/2004 | Richards et al. |
| 6,722,107 | B2 | 4/2004 | Morand |
| 6,804,930 | B2 | 10/2004 | Stravitz |
| 6,901,974 | B2 | 6/2005 | Chomik et al. |
| 6,925,781 | B1 | 8/2005 | Knuth et al. |
| 6,941,733 | B2 | 9/2005 | Chomik et al. |
| 6,993,891 | B2 | 2/2006 | Richardson et al. |
| 6,994,247 | B2 | 2/2006 | Richards |
| D517,761 | S | 3/2006 | Yang et al. |
| 7,044,323 | B2 | 5/2006 | Yang et al. |
| 7,086,550 | B2 | 8/2006 | Yang et al. |
| 7,114,314 | B2 | 10/2006 | Stravitz |
| 7,114,534 | B2 | 10/2006 | Chomik et al. |
| 7,121,421 | B2 | 10/2006 | Yang et al. |
| 7,146,785 | B2 | 12/2006 | Stravitz |
| 7,178,314 | B2 | 2/2007 | Chomik et al. |
| D538,500 | S | 3/2007 | Lin |
| 7,225,943 | B2 | 6/2007 | Yang et al. |
| 7,264,133 | B2 | 9/2007 | Yang et al. |
| D596,364 | S * | 7/2009 | Morand ..... D34/7 |
| 7,696,711 | B2 * | 4/2010 | Pollack et al. ..... 318/466 |
| 2002/0065500 | A1 | 5/2002 | Rossi |
| 2003/0010415 | A1 | 1/2003 | Szuszkiewicz |
| 2003/0213804 | A1 | 11/2003 | Chomik et al. |
| 2003/0230579 | A1 | 12/2003 | Chomik et al. |
| 2004/0134914 | A1 | 7/2004 | Richards |
| 2005/0106706 | A1 | 5/2005 | Chomik et al. |
| 2005/0178767 | A1 | 8/2005 | Hletko |
| 2005/0199641 | A1 | 9/2005 | Yang et al. |
| 2005/0284388 | A1 | 12/2005 | Kunz |
| 2005/0284870 | A1 | 12/2005 | Yang et al. |
| 2006/0037289 | A1 | 2/2006 | Chomik et al. |
| 2006/0103086 | A1 * | 5/2006 | Niemeyer et al. ..... 280/47.26 |
| 2006/0226149 | A1 | 10/2006 | Yang et al. |
| 2006/0237461 | A1 | 10/2006 | Chomik et al. |
| 2006/0266749 | A1 | 11/2006 | Yang et al. |
| 2006/0283862 | A1 | 12/2006 | Yang et al. |
| 2007/0125792 | A1 | 6/2007 | Pollack et al. |

FOREIGN PATENT DOCUMENTS

| | | |
|---|---|---|
| JP | 2004/121468 | 4/2004 |
| WO | WO 2006/126879 | 11/2006 |
| WO | WO 2007/056703 | 5/2007 |

* cited by examiner

WASTE CONTAINER

CROSS-REFERENCE TO RELATED APPLICATION

This application claims the benefit of U.S. Provisional Application No. 61/022,289, filed Jan. 18, 2008, the entire disclosure of which is incorporated in its entirety herein by reference thereto.

BACKGROUND OF THE INVENTION

1. Field of the Invention

The present invention relates to waste containers and more particularly to a container for storing animal waste, that minimizes exposure to the user of odor from waste stored in the container.

2. Background Art

Pet waste, particularly canine and feline waste, is commonly stored in individual plastic bags and then disposed of in a trash can, or waste container. The cumulative odor of the pet waste, along with other waste stored within the trash can, can reach an offensive level such that it is difficult to use and the trash can must be emptied before it is full in order to minimize the odor.

There are a variety of known waste containers that minimize odor of human feces by creating individually wrapped packages of waste that are stored in the container. These containers use special liners that are twisted around the waste. These liners can be expensive to replace. Additionally, the cumulative odor escaping from the packages of waste can still become quite strong and offensive such that the waste container must still be emptied before it reaches full capacity.

Furthermore, some waste containers have lids which are effective to contain odors when the container's lid is closed, but the user is exposed to the cumulative odor each time the user opens the lid to place more waste within the container.

Accordingly, the need exists for a waste container which effectively contains the waste odor and minimizes the user from being exposed to the odor even when the user places more waste within the container.

BRIEF SUMMARY OF THE INVENTION

The present invention provides a waste container with an upper lid and an internal lower lid provided over a base chamber in which waste is stored, to minimize a user's exposure to odor from waste.

Presented herein is a waste container having a housing, a top chamber with a first opening for receiving waste; a base chamber disposed below the top chamber having a second opening for receiving waste from the top chamber; an upper lid disposed on the top chamber; a lower lid disposed on the base chamber; and a drive mechanism mechanically coupling the lower lid with the upper lid. In one embodiment, the base chamber has a third opening disposed opposite the second opening, and the waste container includes a storage chamber disposed below the third opening, for containing waste. In another embodiment, the storage chamber includes a bag. The bag may be securely attached to the base chamber below the third opening so as to receive waste passing through the third opening.

The upper lid moves between a closed position covering the first opening of the top chamber and an open position exposing the first opening. The lower lid moves between a closed position covering the second opening of the base chamber and an open position exposing the second opening.

When the upper lid is in the open position, waste is received through the first opening into the top chamber. When the upper lid closes, the lower lid moves to the open position and the waste passes through the second opening into the base chamber. The waste then passes through the third opening of the base chamber into the storage chamber. In one embodiment, the upper lid pivots relative to the top chamber between the closed and open positions. In one embodiment, the lower lid may be hinged to the base chamber.

The drive mechanism is actuated so as to move the lower lid from the closed position to the open position when the upper lid moves toward the closed position from the open position. The lower lid returns from the open position back to the closed position when the upper lid is in the closed position. In one embodiment, the drive mechanism includes a pivot arm having a first end and a second end, and an actuator linkage interposed between the pivot arm and the upper lid. The actuator linkage includes an extension that engages with the first end of pivot arm and forces the pivot arm from a first position to a second position when the drive mechanism is actuated. The lower lid correspondingly moves from the closed position to the open position by force of the second end of the pivot arm on an engagement member of the lower lid. When the pivot arm reaches the second position, the extension of the actuator linkage releases its force on the pivot arm, and the lower lid automatically returns to the closed position. When the lower lid closes, the engagement member of the lower lid places force against the second end of the pivot arm to move the pivot arm back to the first position.

In one embodiment, the lower lid includes a counter weight that biases the lower lid in the closed position. When actuated, the drive mechanism overcomes the bias of the counter weight, and the lower lid is moved from the closed position to the open position by force of the pivot arm. When the extension of the actuator linkage releases its force on the pivot arm, the counter weight automatically returns the lower lid to the closed position and forces the engagement member of the lower lid against the second end of the pivot arm. The pivot arm is thereby moved back to the first position.

Further embodiments, features, and advantages of the present invention, as well as the structure and operation of the various embodiments of the present invention, are described in detail below with reference to the accompanying drawings in which like reference numerals are used to describe similar features.

BRIEF DESCRIPTION OF THE DRAWINGS/FIGURES

The accompanying figures, which are incorporated herein and form part of the specification, illustrate a waste container. Together with the description, the figures further serve to explain the principles of the waste container described herein and thereby enable a person skilled in the pertinent art to make and use the waste container.

DETAILED DESCRIPTION OF THE INVENTION

Figure 1:
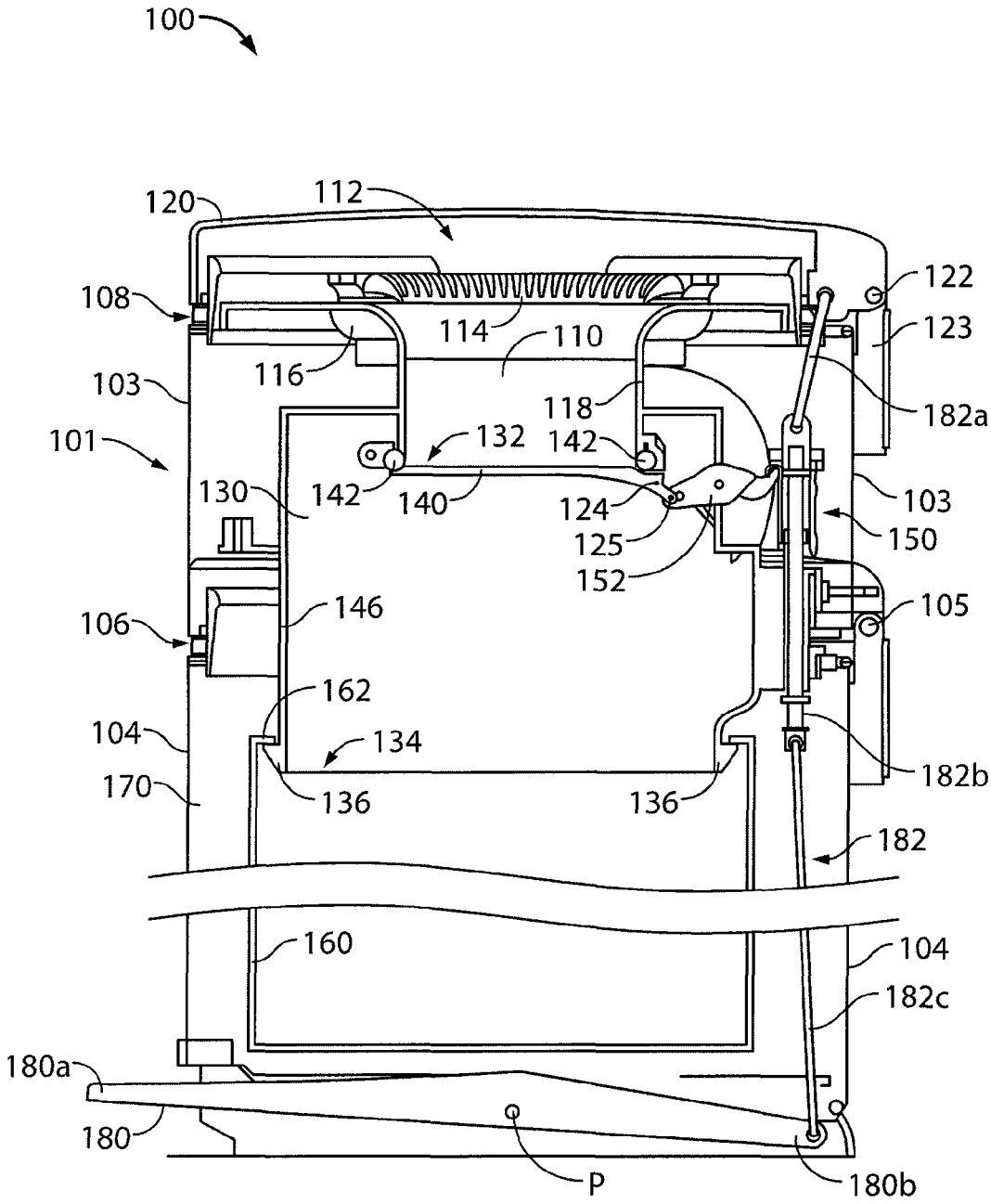
FIG. 1 is a schematic cross-sectional view of a waste container, in accordance with an embodiment of the present invention, showing an upper lid and a lower lid in closed positions.

Reference will now be made in detail to embodiments of the present invention with reference to the accompanying figures, in which like reference numerals indicate like elements.

FIGS. 1-5 show a waste container in accordance with one embodiment of the present invention. Waste container 100 may be used, for example, to hold pet waste. Waste container 100 includes a housing 101 with a first portion 103 and a second portion 104. An upper lid 120 is located at the top of first portion 103, which includes a top chamber 110 and a base chamber 130. Second portion 104 is located at the bottom of housing 101 and defines a storage chamber 170 for holding waste. Storage chamber 170 includes a bag 160 therein.

Top chamber 110 includes a first opening 112 for receiving waste when upper lid 120 is opened. Top chamber 110 may also contain a plurality of air fresheners and/or odor absorbers 114. In one embodiment, the plurality of optional odor absorbers 114 may be held in recesses 116 in top chamber 110 and fixed thereto by an attachment mechanism (not shown). For example, odor absorbers 114 may be interference fitted into recesses 116 or attached via clips, Velcro™, snaps or any other suitable attachment mechanism.

Base chamber 130 is coupled to top chamber 110 and includes a second opening 132 which is located at the top of base chamber 130 and which faces top chamber 110 opposite of first opening 112. Between first opening 112 and second opening 132 are walls 118 which define a chute for transferring waste therethrough. Base chamber 130 includes a third opening 134 disposed at the bottom of base chamber 130, opposite to second opening 132 and facing storage chamber 170. Between second opening 132 and third opening 134 are walls 146, which define a chute for transferring waste therethrough to storage chamber 170.

In the embodiment of FIG. 1, bag 160 extends within storage chamber 170 and has an open end 167 (see FIG. 11A) that communicates with third opening 134. In one embodiment, an outer surface of walls 146 at a bottom portion of base chamber 130 may include laterally extending flanges 136 adjacent to third opening 134 for holding bag 160. Bag 160 may be secured above flanges 136 of base chamber 130 by a securing mechanism 162. Securing mechanism 162 may also create a seal around third opening 134 to minimize the escape of odor from waste 200. Securing mechanism 162 may be an elastic cord, a zip tie, or a cord provided with an adjustable cord lock, for example, or any other suitable securing mechanism known to one of ordinary skill in the art that allows bag 160 to be securely attached to base chamber 130.

Upper lid 120 is disposed on top chamber 110 to selectively cover first opening 112. The upper lid may pivot relative to top chamber 110 by means of a hinge mechanism 122. Hinge mechanism may be mounted on a support 123 fixed to first portion 103 of housing 101. Upper lid 120 moves between a closed position (shown in FIG. 1) covering first opening 112 and an open position (shown in FIG. 2) exposing first opening 112. The upper lid may be biased to the closed position, and may also include a lock mechanism (not shown) at an access position 108 for keeping the upper lid closed. The housing, upper lid and lower lid may be formed of any sturdy material, including metal or plastic. The hinge mechanism may be metal or plastic, and may be mounted to the housing by bolts. If the housing is plastic, the housing may be molded to include integral plastic hinge mounts, instead of bolts, for supporting the metal hinge.

A lower lid 140 is disposed on base chamber 130 to selectively cover second opening 132. Lower lid 140 may be pivotally attached to base chamber 130 by means of a hinge mechanism 124. In particular, lower lid 140 moves between a closed position (shown in FIG. 1) covering second opening 132 and a open position (shown in FIG. 4) exposing second opening 132. When lower lid 140 is in the open position, waste may be received through second opening 132. In one embodiment, when in the closed position, lower lid 140 creates an airtight seal 142 so that odor from waste will not escape from second opening 132. Lower lid 140 may be pivoted between the open and closed positions by rotation of a pivot arm 152 of a drive mechanism 150 that mechanically couples lower lid 140 with upper lid 120. Drive mechanism 150 may include a plurality of components that interact with one another to automatically move the lower lid from the closed position to the open position when the upper lid returns to the closed position. Drive mechanism 150 may be formed of any sturdy material, preferably metal. Further description of an embodiment of drive mechanism 150 and its operation is provided below with reference to FIGS. 7, 7A-C, 8, 8A-C, 9, 9A-C, 10, and 10A-C. Pivot arm 152 may be permanently attached to lower lid 140 by a hinge mechanism 125 joining an end of lower lid 140 to pivot arm 152. In another embodiment, lower lid 140 may include an engagement member (such as pin 158 shown in FIG. 7C) which engages with pivot arm 152 without being permanently attached to pivot arm 152.

Lower lid 140 may be biased in the closed position to hold waste in top chamber 110 until lower lid 140 is pivoted by pivot arm 152. For example, lower lid 140 may be biased in the closed position by a counter weight 144 (shown in FIG. 7C), which may have a selected weight that counteracts an anticipated weight of waste deposited in top chamber 110. As such, counter weight 144 may maintain lower lid 140 in the closed position when waste is placed on lower lid 140 (see FIG. 3). For example, counter weight 144 may include an 8 oz weight, whereby waste of equal to or less than 8 oz deposited in top chamber 110 will not force lower lid 140 open. In this instance, a force from pivot arm 152 may be applied to lower lid 140 to overcome the opposite force of counter weight 144 and pull lower lid 140 towards the open position.

To facilitate the movement of upper lid 120 between the closed position and the open position, a foot-actuated mechanism 180, such as a conventional foot pedal, may be located at a base of waste container 100. In one embodiment, foot-actuated mechanism 180 includes a rod having a fulcrum at a pivot point P, with one end 180*a* of the rod extending laterally from housing 101 so as to be easily engaged by a foot of a user, and another end 180*b* of the rod joined to a linkage 182 mechanically coupling foot-actuated mechanism 180 with upper lid 120. Linkage 182 may include a top, middle, and bottom vertically extending linkage rods 182*a*, 182*b*, and 182*c*, respectively, which are mechanically coupled so as to transfer force from actuation of foot-actuated mechanism 180 to upper lid 120. As further described below with reference to FIG. 7B, drive mechanism 150 may be mechanically interposed between top linkage 182*a* and middle linkage 182*b* such that top linkage 182*a* and/or middle linkage 182*b* actuate drive mechanism 150 for moving lower lid 140 to the open position. In one embodiment, a hand-actuated mechanism (not shown) may be used in place of, or in addition to, foot-actuated mechanism 180. In another embodiment, upper lid 120 may be manually moved to the closed and open positions.

Figure 2:
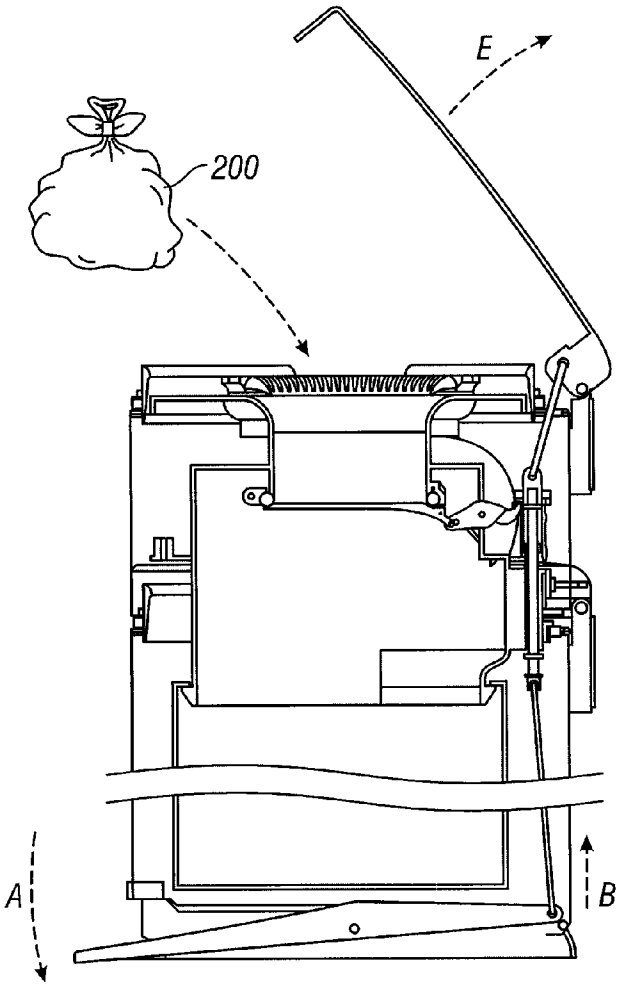
FIG. 2 is a schematic cross-sectional view of the waste container of FIG. 1, showing the upper lid in an open position.

Description of operation of waste container 100 to dispose of a bag of waste 200 will now be described with reference to FIGS. 2-5. As shown in FIG. 2, when a user applies downward pressure to end 180*a* of foot-actuated mechanism 180 the direction of arrow A, upper lid 120 is moved in direction of arrow E from the closed position to the open position via linkage 182. In particular, as downward pressure is applied to end 180*a*, linkage 182 is forced upward in the direction of arrow B so as to open upper lid 120 and expose first opening 112, whereby waste 200 may be deposited into top chamber 110.

Figure 3:
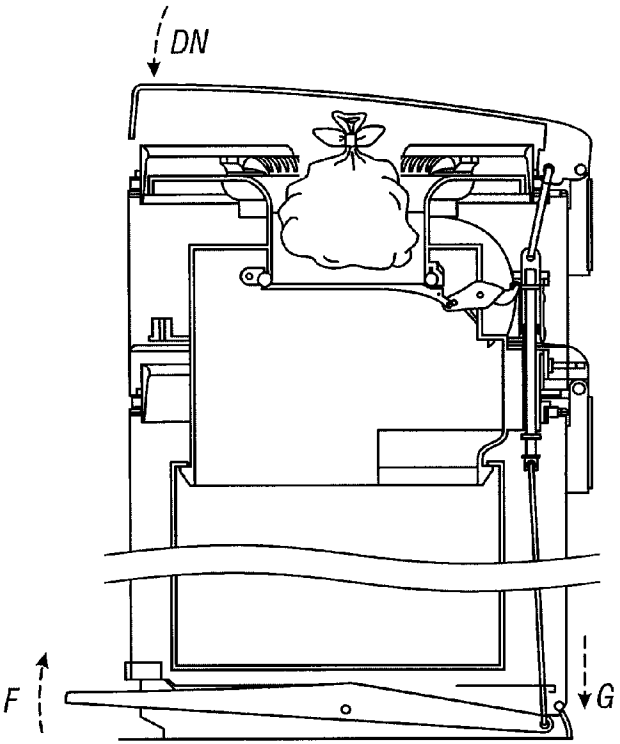
FIG. 3 is a schematic cross-sectional view of the waste container of FIG. 1, showing the upper lid returning to the closed position.

As shown in FIG. 3, foot-actuated mechanism 180 is released and biasing back to its steady state position by pivoting upward in the direction of arrow F, and linkage 182 simultaneously moves downward in the direction of arrow G. When foot-actuated mechanism is released, upper lid 120 moves in the direction of arrow DN to the closed position. As described above, lower lid 140 may be biased in the closed position so that waste is held in top chamber 110 until upper lid 120 closes.

Figure 4:
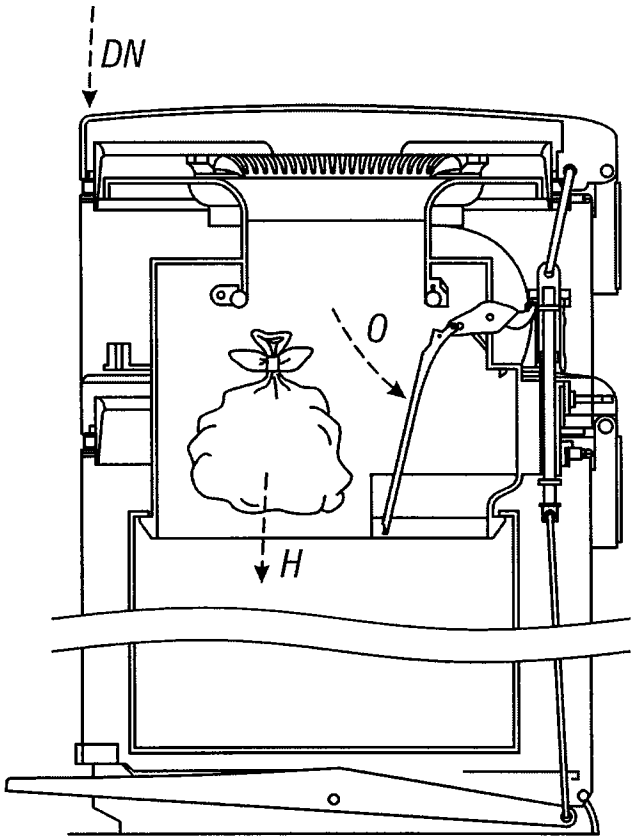
FIG. 4 is a schematic cross-sectional view of the waste container of FIG. 1, showing the lower lid in an open position.

As shown in FIG. 4, drive mechanism 150 is actuated upon movement of upper lid 120 to the closed position, and moves lower lid 140 from the closed position to the open position. In particular, pivot arm 152 of drive mechanism 150 pulls lower lid 140 in the direction of arrow O to the open position. Upon opening of lower lid 140, second opening 132 is exposed, whereby waste 200 passes from top chamber 110 through second opening 132 into base chamber 130 in the direction of arrow H.

Figure 5:
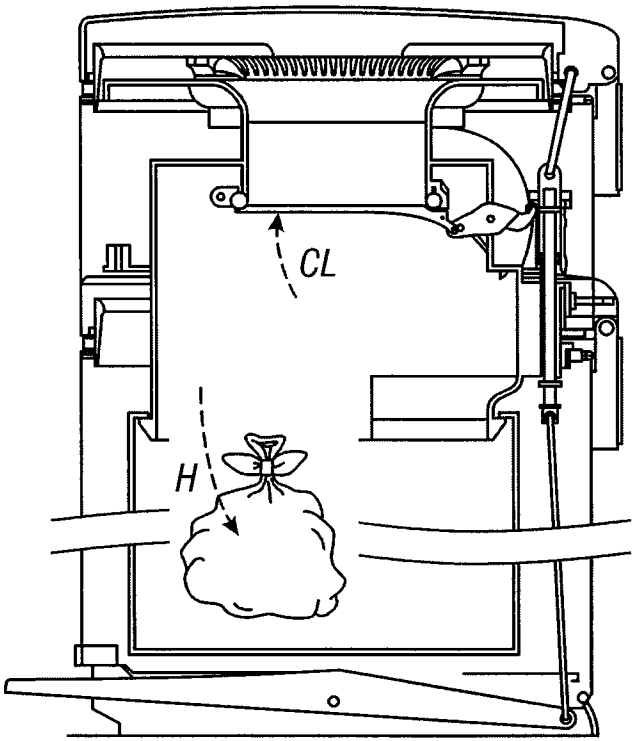
FIG. 5 is schematic cross-sectional view of the waste container of FIG. 1, showing the lower lid returned to the closed position.

As shown in FIG. 5, waste 200 continues to move in the direction of arrow H, and passes through third opening 134 of base chamber 130 into bag 160 of storage chamber 170. Drive mechanism 150 releases lower lid 140 so as to allow lower lid 140 to bias back in the direction of arrow CL to the closed position, minimizing subsequent escape of odor of waste 200 held in storage chamber 170.

Figure 6A:
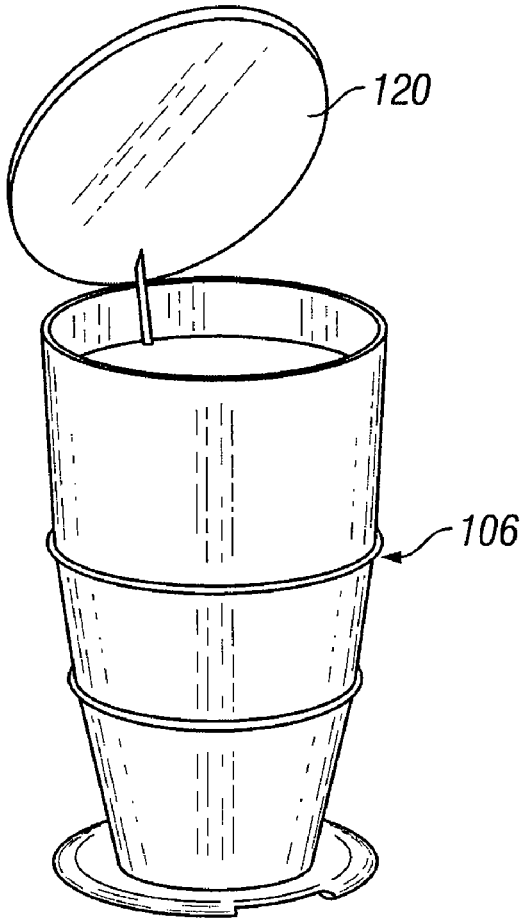
FIG. 6A is a perspective view of a waste container with an upper lid open, in accordance with an embodiment of the present invention.
Figure 6B:
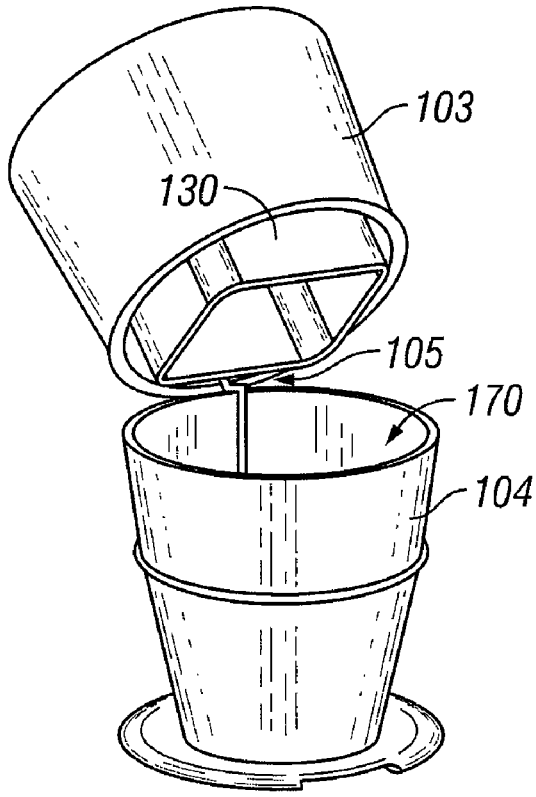
FIG. 6B is a perspective view of the waste container of FIG. 6A, showing a housing of the container hinged open at a midsection for accessing a waste storage chamber.

Storage chamber 170 holds waste until a user is ready to empty waste container 100. To facilitate emptying waste chamber 170, first portion 103 of housing 101 may be pivotally joined to second portion 104 by a hinge mechanism 105, shown in FIG. 1. A user may access storage chamber 170 at an access position 106 at the junction of first portion 103 and second portion 104, by pivoting first portion 103 pivoted away from second portion 104. A locking mechanism (not shown) may be provided at access position 106 to secure first and second portions 103 and 104 together until the user desires to access storage chamber 170 for removal of waste held therein. FIGS. 6A and 6B illustrate an embodiment of a waste container having first and second portions 103 and 104 hinged together. FIG. 6B shows the waste container with first portion 103 pivoted upward, away from second portion 104, for accessing storage chamber 170.

To dispose of bag 160, a user may pivot first portion 103 away from second portion 104 to access bag 160. Since bag 160 is secured to base chamber 130, as described above, bag 160 will travel with the pivoting of base chamber and hang there from. The user may then grasp bag 160 below securing mechanism 162 to cinch it closed and pull securing mechanism 162 over flanges 136, in order to release bag 160 from the lower rim of base chamber 130. Where securing mechanism 162 is a hook-and-eye cord or includes a cord lock, a user may need to unfasten the hook-and-eye (or adjust the cord lock) to pull the cord over flanges 136. If a zip tie is used as securing mechanism 162, the user may have to cut the zip tie to disengage bag 160 from base chamber 130.

Figure 7:
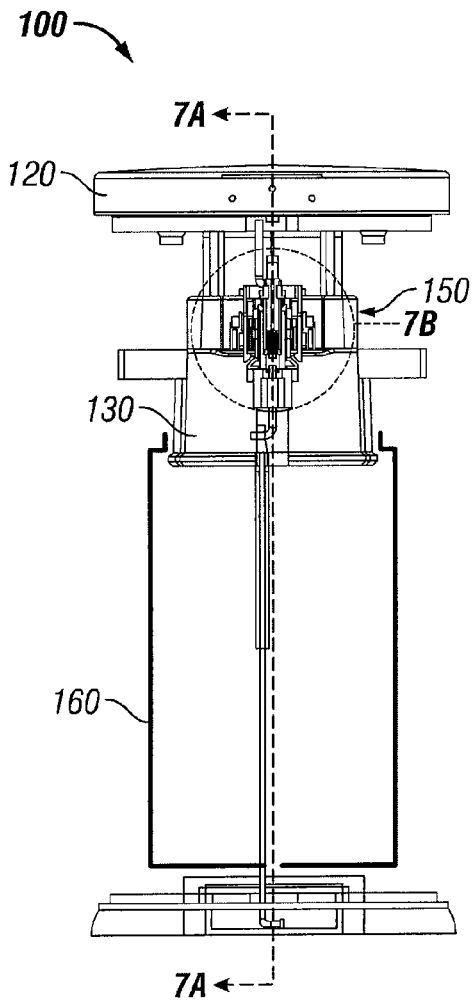
FIG. 7 is a rear view of a waste container having a drive mechanism for coupling a lower lid with an upper lid, in accordance with an embodiment of the present invention.
Figure 7A:
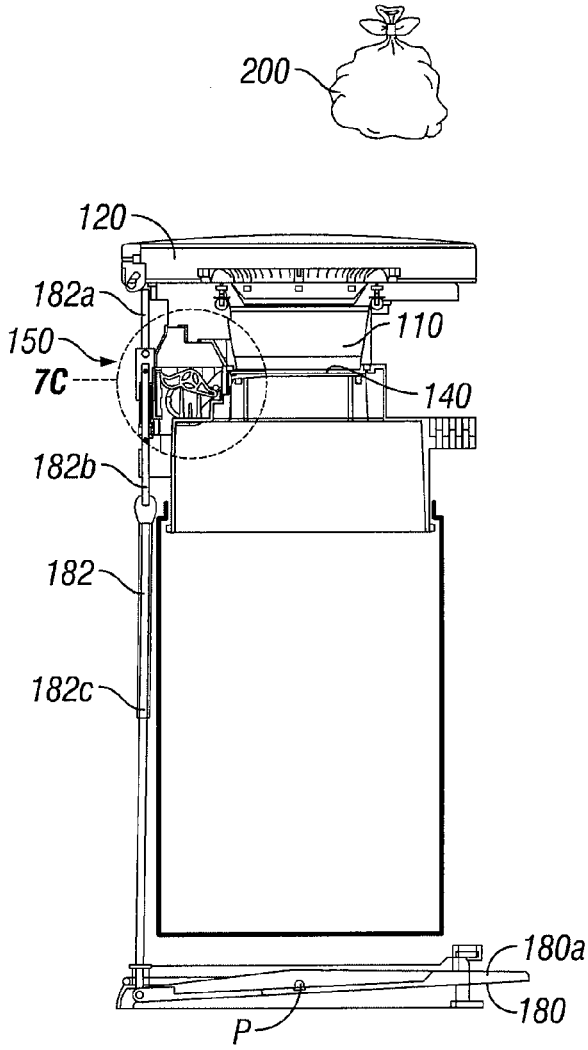
FIG. 7A is a schematic cross-sectional view taken along line 7A-7A of FIG. 7.
Figure 7B:
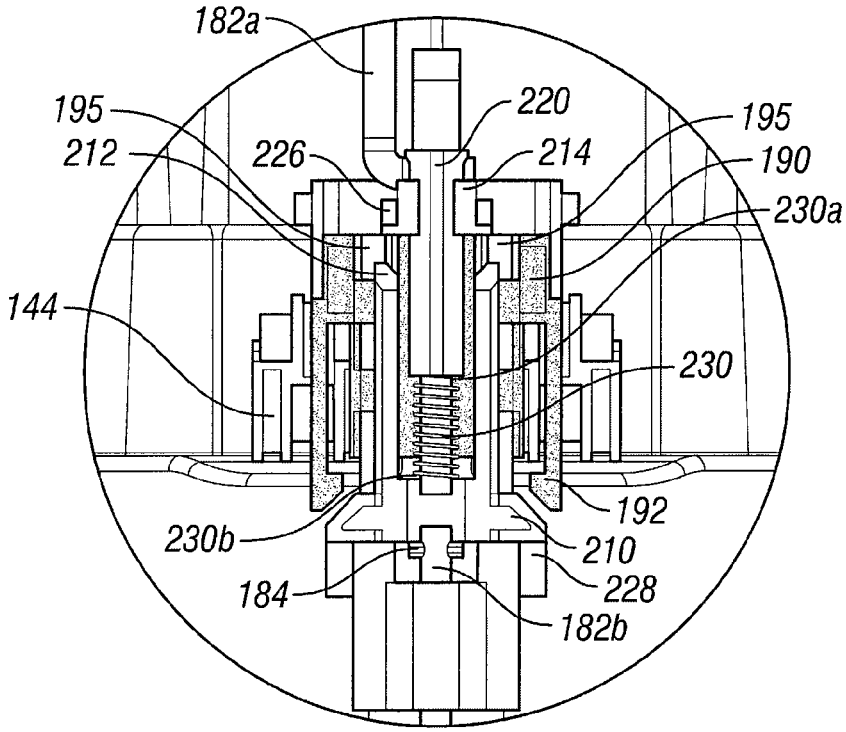
FIG. 7B is an enlarged view of circled portion 7B of FIG. 7.

An embodiment of drive mechanism 150 and its operation will now be described with reference to FIGS. 7, 7A-C, 8, 8A-C, 9, 9A-C, 10, and 10A-C. In the embodiment of FIG. 7, housing 101 is excluded, with bag 160 exposed. FIGS. 7 and 7A show waste container 100 with upper lid 120 in the closed position. In this position, drive mechanism 150 is in its relaxed position, as illustrated by the detailed views of FIGS. 7B and 7C. In the embodiment shown, drive mechanism 150 includes an actuator 190 having actuator hooks 192, a latch 210 having latch hooks 212, a plunger 220, and a spring 230 interposed between plunger 220 and latch 210. Actuator 190 is moveably disposed on guide rails 195. Spring 230 has a first end 230*a* coupled to plunger 220 and movable therewith and a second end 230*b* coupled to latch 210 and movable therewith. Top linkage 182*a* is coupled to plunger 220, which includes upper release tabs 226 for unlatching latch hooks 212 from upper latch 214. Lower release tabs 228 are fixed to wall 146 of base chamber 130, for unlatching actuator hooks 192 from latch 210. In the relaxed position of drive mechanism 150, spring 230 is in an unloaded position, with actuator hooks 192 of actuator 190 disengaged from latch 210, and latch hooks 212 of latch 210 disengaged from an upper latch 214 that is fixed to an outer wall 119 of top chamber 110.

Figure 7C:
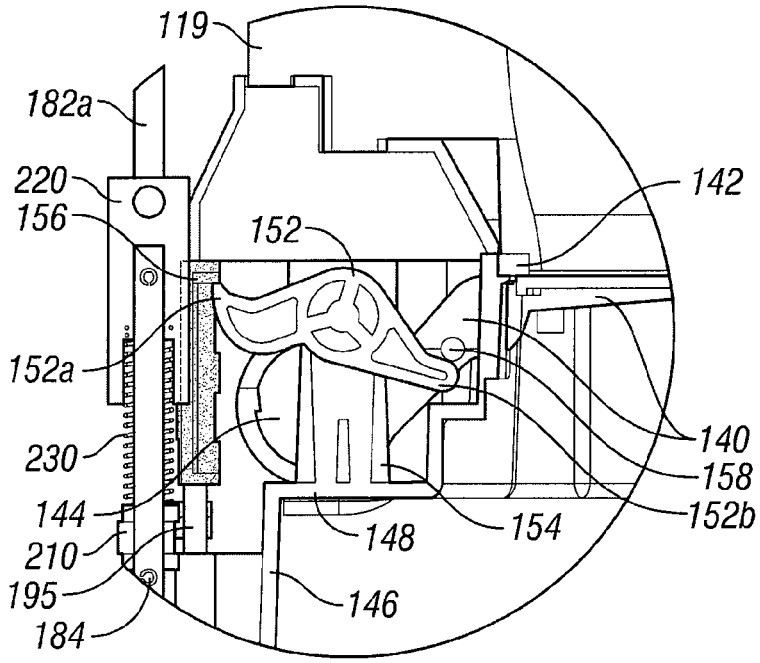
FIG. 7C is an enlarged view of circled portion 7C of FIG. 7A.

As shown in FIG. 7C, actuator 190 includes an extension 156 which engages with pivot arm 152. Specifically, pivot arm 152 has a first end 152*a* that is engaged by extension 156 and an opposite second end 152*b* that is engaged by a pivot pin 158 fixed to lower lid 140. Pivot arm 152 is pivotally disposed on a support 154 vertically extending from a horizontal wall 148 of base chamber 130. Lower lid 140 is also pivotally disposed on base chamber 130 with one portion extending over second opening 132 (see FIG. 1), and another portion extending outside of base chamber 130 onto which counter weight 144 is provided. As noted above, counterweight 144 biases lower lid 140 in the closed position. In this position, pivot pin 158 bears against end 152*b* of pivot arm 152, causing end 152*a* of pivot arm 152 to bear against extension 156 of actuator 190.

Figure 8:
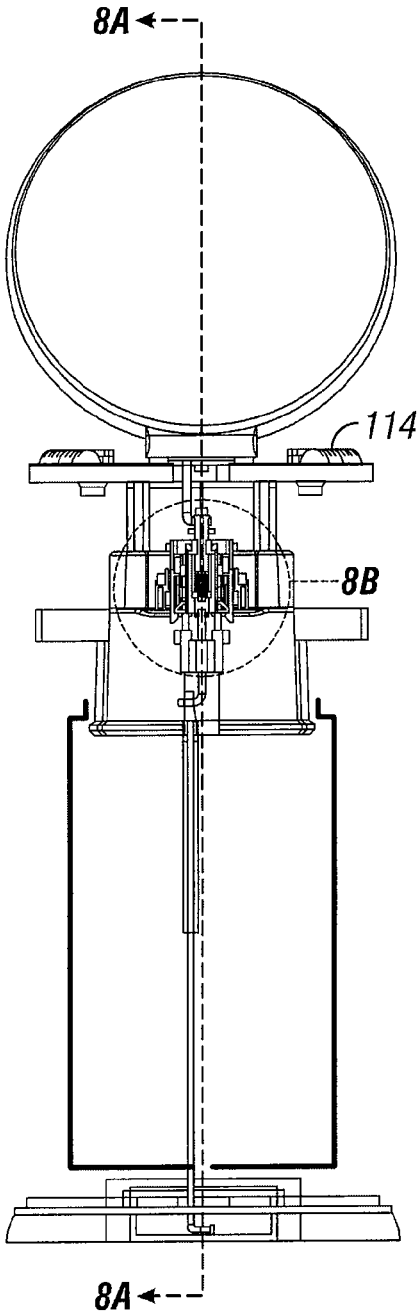
FIG. 8 is a rear view of the waste container of FIG. 7 showing the upper lid opening.
Figure 8A:
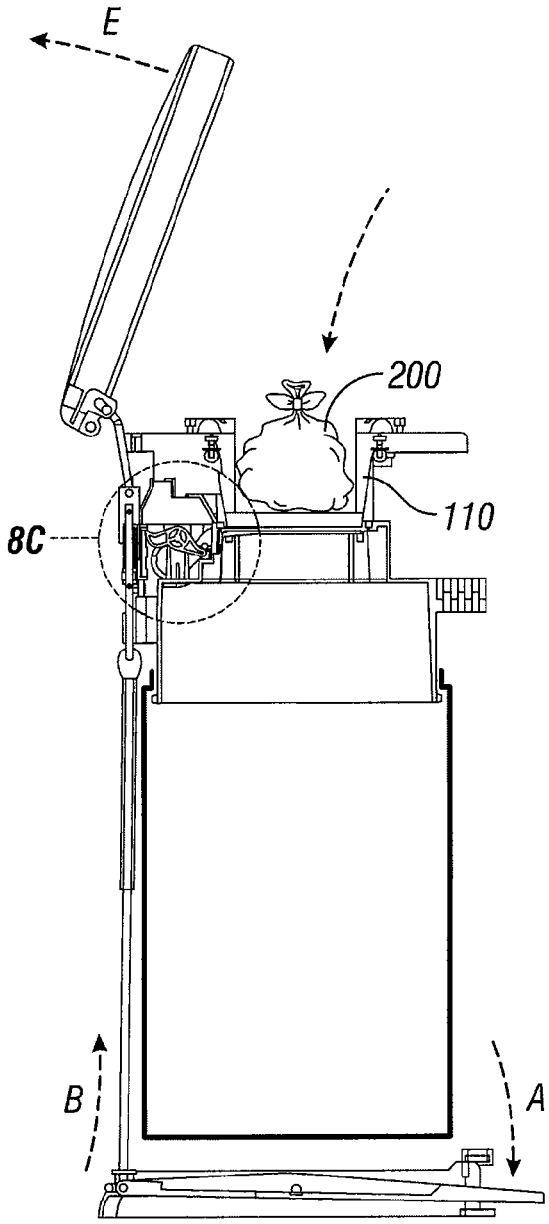
FIG. 8A is a schematic cross-sectional view taken along line 8A-8A of FIG. 8.
Figure 8B:
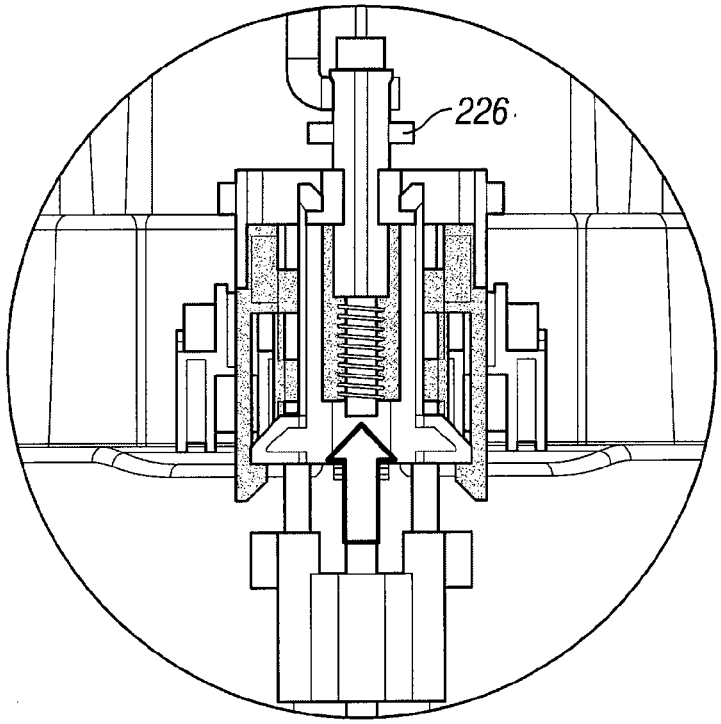
FIG. 8B is an enlarged view of circled portion 8B of FIG. 8.
Figure 8C:
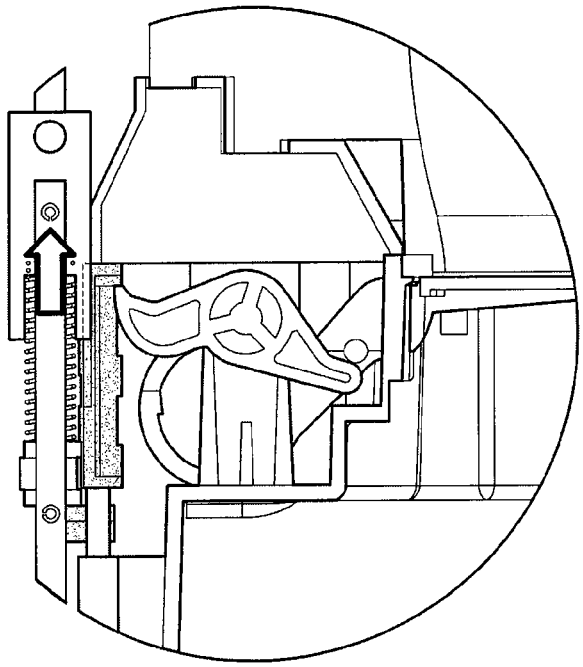
FIG. 8C is an enlarged view of circled portion 8C of FIG. 8A.
Figure 9:
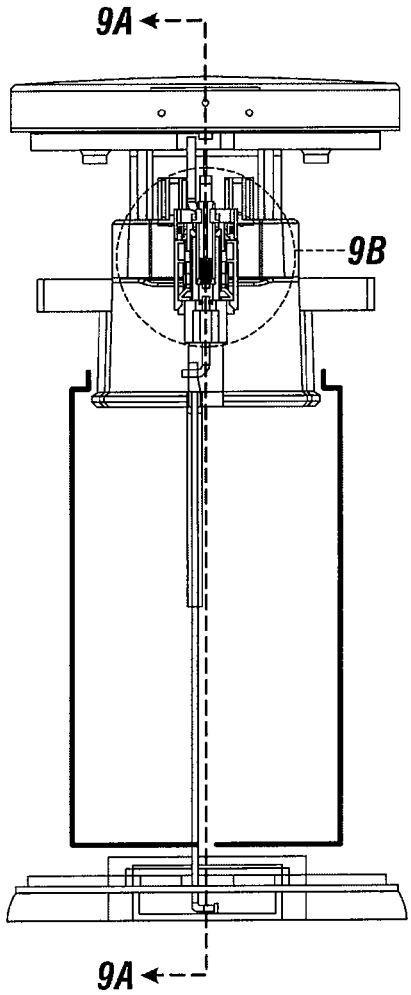
FIG. 9 is a rear view of the waste container of FIG. 7 showing the lower lid opening when the upper lid closes.
Figure 9A:
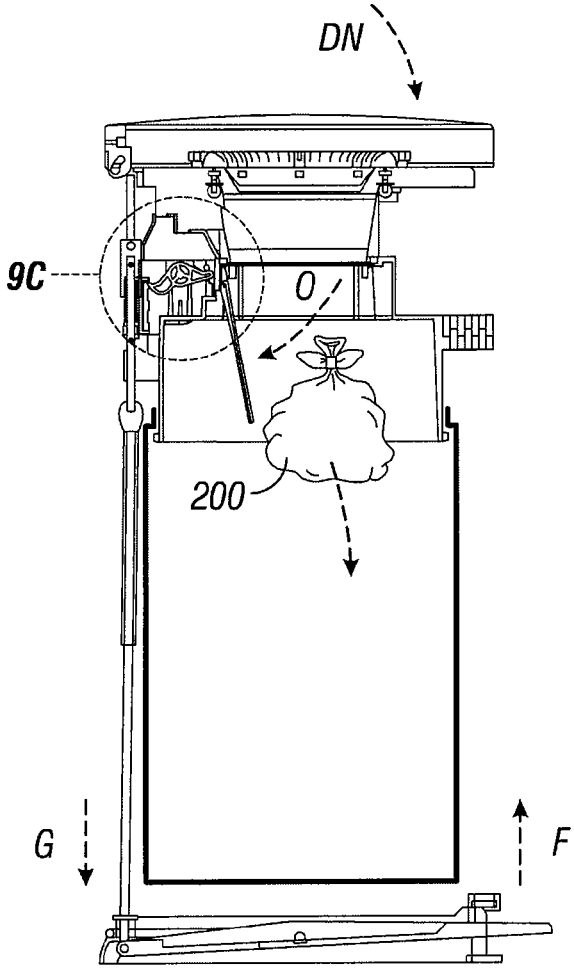
FIG. 9A is a schematic cross-sectional view taken along line 9A-9A of FIG. 9.
Figure 9B:
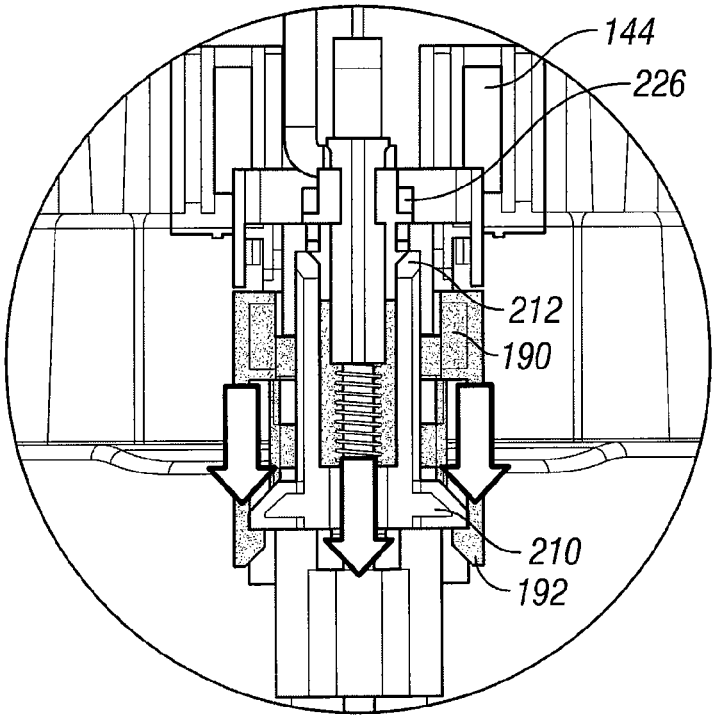
FIG. 9B is an enlarged view of circled portion 9B of FIG. 9.
Figure 9C:
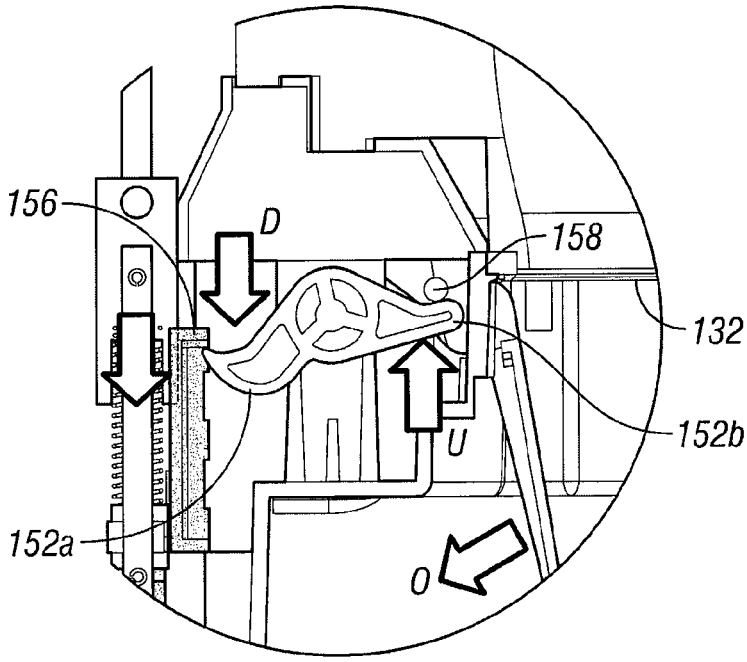
FIG. 9C is an enlarged view of circled portion 9C of FIG. 9A.

Operation of drive mechanism 150 for opening lower lid 140 when upper lid 120 closes will now be described with reference to FIGS. 8 and 8A-8C, 9 and 9A-9C, 10, and 10A-10C. In FIGS. 8 and 8A, upper lid 120 is moved to the open position, whereby waste 200 may be deposited in top chamber 110. As shown in FIGS. 8B and 8C, when upper lid 120 is opened, middle linkage 182*b* pushes latch 210 upward via a pin 184 bearing against a bottom of latch 210 (see FIG. 7B), thereby causing latch hooks 212 to engage with upper latch 214, and actuator hooks 192 to engage with latch 210, as shown in FIG. 8B. The upward movement of linkage 182 is illustrated by the arrows provided in FIGS. 8B and 8C. When linkage 182*b* moves upward, it forces plunger 220 upward as well as top linkage 182*a*, whereby upper lid 120 is opened. As shown in FIGS. 9 and 9A, when foot-actuated mechanism 180 is released, linkage 182 moves downward in the direction of arrow G, whereby upper lid 120 moves to the closed position. This movement of upper lid 120 downward moves plunger 220 toward latch 210 so as to compress spring 230. As shown in FIG. 9B, upper release tabs 226 on plunger 220 contact latch hooks 212, releasing latch hooks 212 from engagement on latch 214. When latch hooks 212 are unlatched by release tabs 226, spring 230 unloads from its compressed position and forces latch 210 downward in the direction of the arrows shown in FIG. 9B. Since actuator hooks 192 are still latched to latch 210, actuator 190 is also forced downward. As shown in FIG. 9C, when actuator 190 moves downward, extension 156 forces end 152*a* of pivot arm 152 downward in the direction of arrow D.

Figure 10:
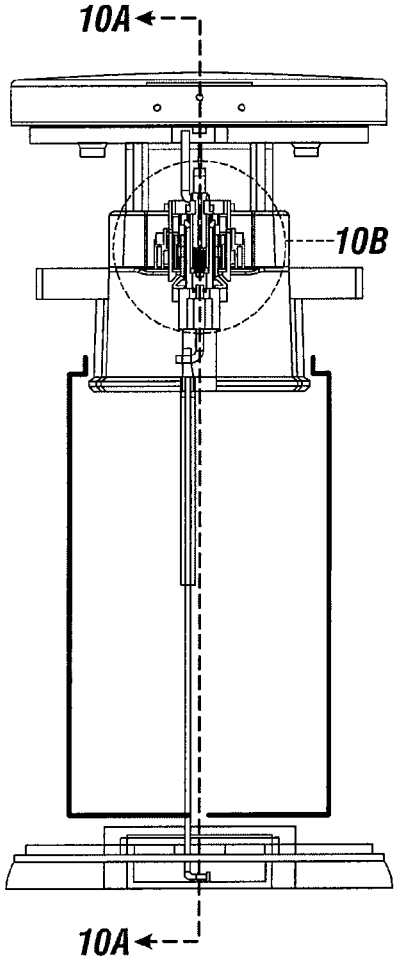
FIG. 10 is a rear view of the waste container of FIG. 7 showing the lower lid closing.
Figure 10A:
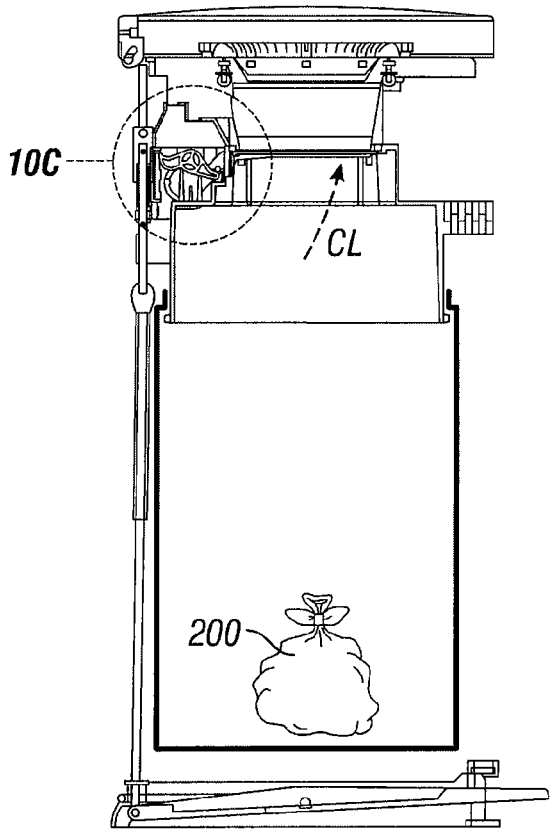
FIG. 10A is a schematic cross-sectional view taken along line 10A-10A of FIG. 10.

Pivot arm 152 then pivots to force opposite end 152*b* upwards in the direction of arrow U, causing end 152*b* to press against pivot pin 158 and move counterweight 144 upward. When counterweight moves upward, lower lid 140 pivots open in the direction of arrow O. Waste 200 then passes from top chamber 110 into base chamber 130 and falls into bag 160 as shown in FIG. 10A.

Figure 10B:
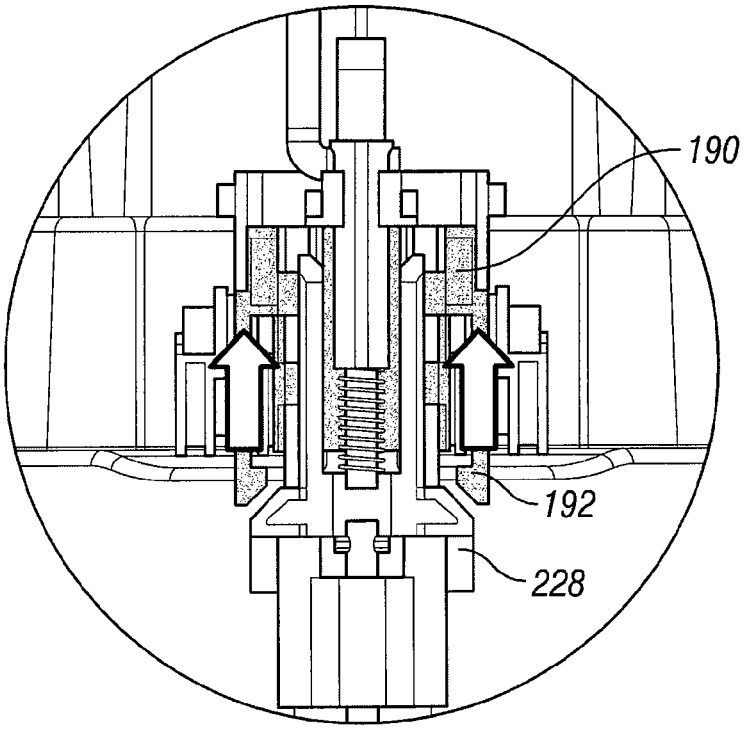
FIG. 10B is an enlarged view of circled portion 10B of FIG. 10.
Figure 10C:
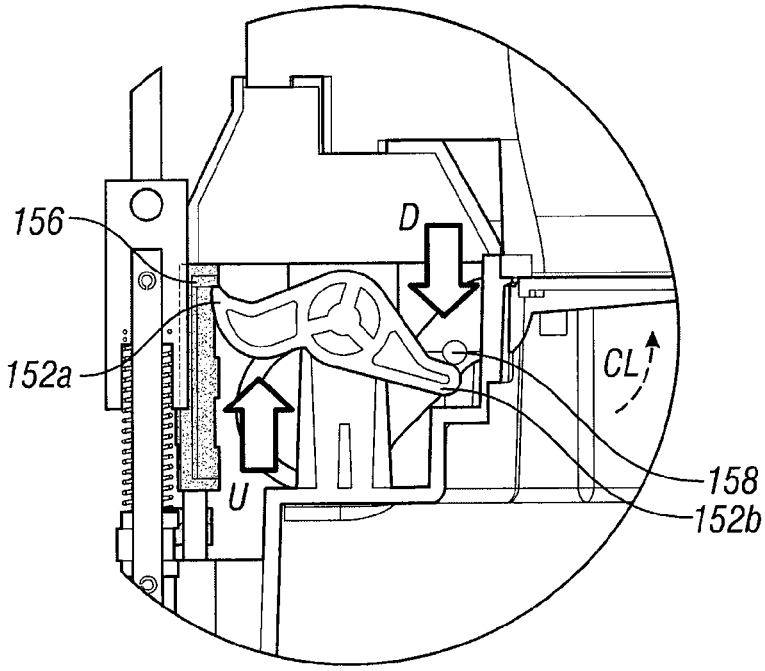
FIG. 10C is an enlarged view of circled portion 10C of FIG. 10A.

At the conclusion of its downward travel, latch 210 forces actuator hooks 192 against lower release tabs 228 (see FIG. 9B), whereby actuator hooks 192 are released from engagement with latch 210 (see FIG. 10B). As shown in FIGS. 10B and 10C, once actuator hooks 192 are unlatched, counterweight 144 moves back down by force of gravity and pivots lower lid 140 to the closed position. Downward movement of counterweight 144 causes pivot pin 158 to press down in the direction of arrow D against end 152*b* of pivot arm 152. Opposite end 152*a* of pivot arm 152 is thereby forced upward in the direction of arrow U and moves actuator 190 upward via extension 156, whereby drive mechanism 150 is returned to its relaxed position.

Figure 11A:
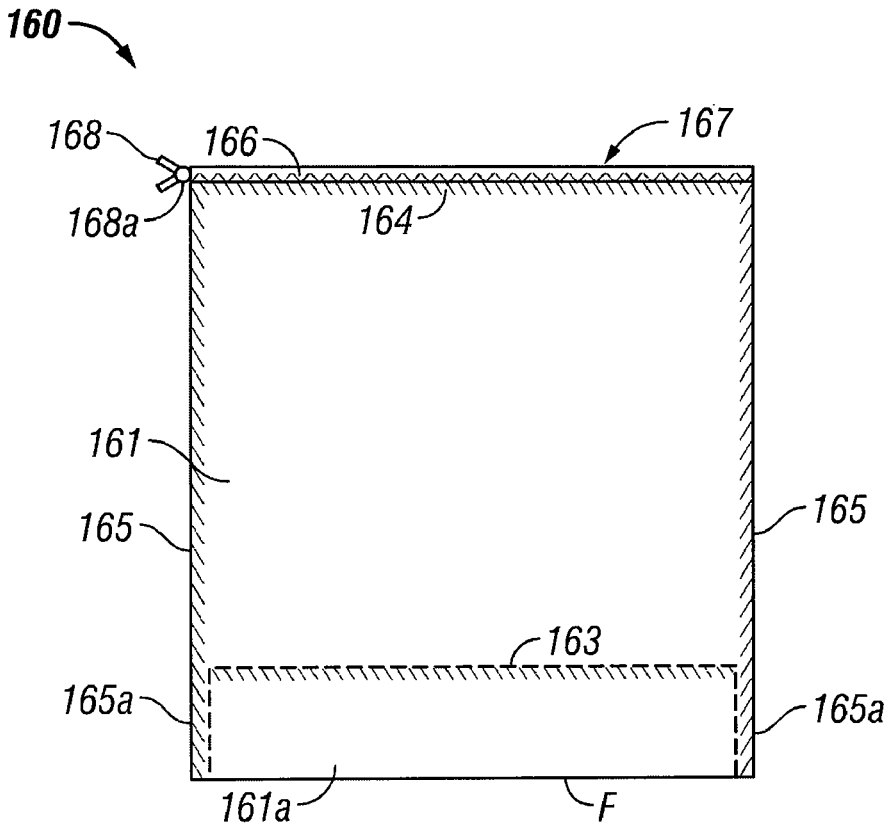
FIG. 11A is a side view of a bag for holding waste in a waste container, in accordance with one embodiment of the present invention.
Figure 11B:
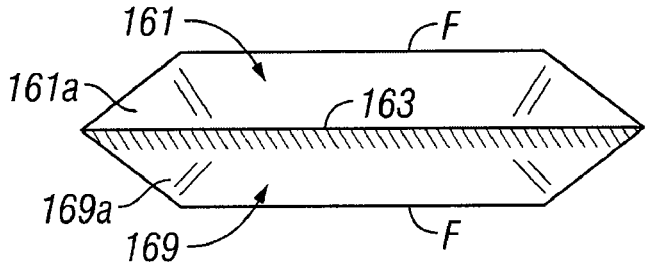
FIG. 11B is a bottom view of the bag of FIG. 11A, illustrating a gusset bottom.

FIGS. 11A and 11B illustrate an embodiment of bag 160 in which an elastic cord 168 is employed as securing mechanism 162. In the embodiment illustrated, bag 160 is formed from two sheets of material that form opposite side walls 161 and 169 joined together along two side edges 165, 165 and along a bottom edge 163. Side walls 161 and 169 may be joined by stitching, adhesive, or more preferably, by heat sealing (seals shown in the figure as hatched marks). Side walls 161 and 169 are preferably formed of substantially nonporous material so as to resist leakage of odor therethrough from waste contained in bag 160. In one embodiment, side walls 161 and 169 of bag 160 may be formed of plastic material, similar to conventional trash bags. In another embodiment, side walls 161 and 169 may be formed of a polyester film, such as polyethylene terephthalate polyester film (e.g., Mylar® brand film).

A top edge 164 of each side wall 161 and 169 is folded over and joined to respective side walls 161 and 169 to form a tube 166 around opening 167 of bag 160. Top edge 164 may be joined to respective side walls 161 and 169 (by stitching, adhesive, or more preferably, by heat sealing (seals shown in the figure as hatched marks)). Elastic cord 168 extends through tube 166, and tube 166 may open at one of edges 165, 165, whereby opposite ends of elastic cord 168 may exit tube 166 and tied together in a knot 168*a*. In one embodiment (not shown), an adjustable cord lock may secure ends of cord 168 together, whereby the cord lock may be used to tighten (or loosen) cord 168 around base chamber 130. In another embodiment (not shown), instead of elastic cord 168, a zip tie extends through tube 166, with the zip tie being tightened when bag 160 is secured to base chamber 130.

Each bottom portion 161*a* and 169*a* of side walls 161 and 169, respectively, folds over at a fold F. Bottom portions 161*a* and 169*a* are joined together along their bottom edges to form bottom edge 163, and are also joined along each portion 165*a*, 165*a* of respective side edges 165, 165. When bottom portions 161*a* and 169*a* are folded so that bag 160 lies flat, bottom portion 161*a* extends along an interior side of side wall 161, and bottom edge 163 extends above fold F, as shown in phantom in FIG. 11A. When bag 160 is opened with bottom edge 163 pushed down, and bottom portions 161*a* and 169*a* are pulled away from the interior sides of side walls 161 and 169, a gusset-like bottom is formed by bottom portions 161*a* and 169*a*, as shown in FIG. 11B. Such gusset-like bottom allows bag 160 to stand upright.

While various embodiments of the present invention have been described above, it should be understood that they have been presented by way of example only, and not limitation. It will be apparent to persons skilled in the relevant art that various changes in form and detail can be made therein without departing from the spirit and scope of the present invention. Thus, the breadth and scope of the present invention should not be limited by any of the above-described exemplary embodiments, but should be defined only in accordance with the following claims and their equivalents.

The invention claimed is:

1. A waste container, comprising a housing including a top chamber with a first opening for receiving waste and a base chamber disposed below the top chamber and having a second opening for receiving waste from the top chamber;

an upper lid disposed on the top chamber that moves between a closed position covering the first opening of the top chamber and an open position exposing the first opening;

a lower lid disposed on the base chamber that moves between a closed position covering the second opening of the base chamber and an open position exposing the second opening; and a drive mechanism mechanically coupling the lower lid with the upper lid, wherein the drive mechanism is configured to be actuated so as to engage and force the lower lid from the closed position to the open position when the upper lid moves toward the closed position from the open position.

2. The waste container of claim 1, wherein the drive mechanism releases its force on the lower lid in the open position so as to allow the lower lid to return from the open position back to the closed position when the upper lid is in the closed position.

3. The waste container of claim 1, wherein the upper lid is hinged to the top chamber.

4. The waste container of claim 1, wherein the lower lid is hinged to the base chamber.

5. The waste container of claim 1, wherein the top chamber is hinged to the base chamber.

6. The waste container of claim 1, wherein the lower lid forms an air tight seal over the second opening when the lower lid is in the closed position.

7. The waste container of claim 1, further comprising an odor absorber disposed in the top chamber.

8. The waste container of claim 1, wherein the drive mechanism is operated by a foot pedal.

9. The waste container of claim 1, wherein the base chamber has a third opening disposed opposite to and below the second opening.

10. The waste container of claim 9, the housing including a storage chamber disposed below the third opening, for containing waste.

11. The waste container of claim 10, wherein the storage chamber includes a bag securely attached to the base chamber below the third opening so as to receive waste passing through the third opening.

12. The waste container of claim 1, wherein the drive mechanism includes a pivot arm having a first end and a second end, and an actuator linkage interposed between the pivot arm and the upper lid.

13. The waste container of claim 12, wherein the actuator linkage includes an extension that engages with the first end of pivot arm and forces the pivot arm from a first position to a second position when the drive mechanism is actuated, wherein the lower lid correspondingly moves from the closed position to the open position by force of the second end of the pivot arm on an engagement member of the lower lid.

14. The waste container of claim 13, wherein the extension of the actuator linkage releases its force on the pivot arm when the pivot arm reaches the second position, wherein the lower lid automatically returns to the closed position.

15. The waste container of claim 14, wherein, when the lower lid closes, the engagement member of the lower lid places force against the second end of the pivot arm so as to move the pivot arm back to the first position.

16. The waste container of claim 13, wherein the lower lid includes a counter weight that biases the lower lid in the closed position, wherein upon actuation, the drive mechanism overcomes the bias of the counter weight, and the lower lid is moved from the closed position to the open position by force of the pivot arm.

17. The waste container of claim 16, wherein when the extension of the actuator linkage releases its force on the pivot arm, the counter weight automatically returns the lower lid to the closed position and forces the engagement member of the lower lid against the second end of the pivot arm so as to move the pivot arm back to the first position.

18. A method for storing waste in a waste container, comprising:

opening an upper lid disposed on a top chamber from a closed position to an open position so as to expose a first opening in the top chamber;

placing waste into the exposed first opening, wherein the waste passes through the first opening into the top chamber; and moving the upper lid from the open position toward the closed position so as to actuate a drive mechanism that engages and forces a lower lid from a closed position to the open position, the lower lid being disposed on a base chamber that is connected to the top chamber below the first opening and includes a second opening for receiving waste from the top chamber, wherein the lower lid covers the second opening when the lower lid is in the closed position and exposes the second opening when the lower lid is in the open position, wherein the waste passes through the second opening into the base chamber from the top chamber.

19. The method of claim 18, wherein the base chamber includes a third opening opposite the second opening, wherein the waste passes from the base chamber through the third opening into a storage chamber disposed below the third opening.

20. The method of claim 18, wherein the drive mechanism releases its force on the lower lid in the open position so as to allow the lower lid to return from the open position back to the closed position when the upper lid is in the closed position.

* * * * *